US010227869B2

(12) United States Patent
Doheny, II et al.

(10) Patent No.: US 10,227,869 B2
(45) Date of Patent: Mar. 12, 2019

(54) SYSTEM AND METHOD OF DETECTING DULL AND WORN CUTTER BITS

(71) Applicant: Joy MM Delaware, Inc., Wilmington, DE (US)

(72) Inventors: Edward L. Doheny, II, River Hills, WI (US); Ben Snyman, Mars, PA (US); David Stryffeler, Franklin, PA (US); Anthony Reid, Whitefish Bay, WI (US); Hekkie van Dyk, Wexford, PA (US)

(73) Assignee: Joy Global Underground Mining LLC, Warrendale, PA (US)

( * ) Notice: Subject to any disclaimer, the term of this patent is extended or adjusted under 35 U.S.C. 154(b) by 0 days.

(21) Appl. No.: 15/891,920

(22) Filed: Feb. 8, 2018

(65) Prior Publication Data

US 2018/0163538 A1 Jun. 14, 2018

Related U.S. Application Data

(63) Continuation of application No. 15/094,037, filed on Apr. 8, 2016, now Pat. No. 9,920,624.

(60) Provisional application No. 62/145,377, filed on Apr. 9, 2015.

(51) Int. Cl.
*E21C 25/10* (2006.01)
*E21C 35/00* (2006.01)

(52) U.S. Cl.
CPC ..... *E21C 25/10* (2013.01); *E21C 35/00* (2013.01)

(58) Field of Classification Search
CPC ..... E21C 25/02; E21C 25/06; E21C 25/10; E01C 23/088
USPC ..... 299/1.05–1.2, 1.4–1.9; 404/90–94
See application file for complete search history.

(56) References Cited

U.S. PATENT DOCUMENTS

| | | | |
|---|---|---|---|
| 3,694,837 | A | 9/1972 | Edwin et al. |
| 3,841,149 | A | 10/1974 | Edwin et al. |
| 4,251,872 | A | 2/1981 | Bone |
| 4,765,894 | A | 11/1988 | Davis, Jr. et al. |
| 5,335,977 | A | 8/1994 | Morrell et al. |
| 5,349,337 | A | 9/1994 | McCormick |
| 5,438,860 | A | 8/1995 | Kawai et al. |
| 6,857,706 | B2 | 2/2005 | Hames et al. |

(Continued)

FOREIGN PATENT DOCUMENTS

| | | |
|---|---|---|
| DE | 3505408 | 8/1986 |
| DE | 3616170 | 3/1987 |

(Continued)

OTHER PUBLICATIONS

Office Action from the German Patent and Trademark Office for Application No. 102016205908.4 dated Sep. 5, 2016 (4 pages).

(Continued)

*Primary Examiner* — Sunil Singh
(74) *Attorney, Agent, or Firm* — Michael Best & Friedrich LLP

(57) ABSTRACT

A mining machine including a chassis, an actuator, a cutter drum supported by the chassis, the cutter drum driven by the actuator, a cutter bit coupled to the cutter drum, and a controller. The controller includes a processor and memory and is configured to measure a characteristic of the actuator, determine the cutter bit is worn based on the measured characteristic of the actuator, and output a signal when the cutter bit is determined to be worn.

20 Claims, 6 Drawing Sheets

(56) References Cited

U.S. PATENT DOCUMENTS

| | | | | |
|---|---|---|---|---|
| 7,887,142 | B2 | 2/2011 | Hall et al. | |
| 8,386,196 | B2 | 2/2013 | Wagner et al. | |
| 8,738,304 | B2 | 5/2014 | Hall et al. | |
| 8,820,845 | B2 | 9/2014 | Hall | |
| 2005/0168048 | A1* | 8/2005 | Gaertner | E01C 23/088 299/1.5 |
| 2010/0139987 | A1 | 6/2010 | Hunt et al. | |
| 2011/0290560 | A1 | 12/2011 | Buske et al. | |
| 2013/0082510 | A1* | 4/2013 | O'Neill | E21C 31/02 299/42 |
| 2014/0081533 | A1 | 3/2014 | O'Neill | |
| 2015/0032433 | A1* | 1/2015 | Li | E21C 25/10 703/7 |

FOREIGN PATENT DOCUMENTS

| | | |
|---|---|---|
| DE | 4415824 | 11/1995 |
| DE | 102005016346 | 1/2007 |
| FR | 2815999 | 5/2002 |
| JP | H06102029 | 4/1994 |
| JP | H0941863 | 2/1997 |
| WO | 2014066981 | 5/2014 |

OTHER PUBLICATIONS

Combined Search Report and Examination Report from the United Kingdom Intellectual Property Office for Application No. GB1606028.7 dated Sep. 19, 2016 (5 pages).
Examination Report from the United Kingdom Patent Office for Application No. GB1606028.7 dated Oct. 8, 2018 (3 pages).

* cited by examiner

SYSTEM AND METHOD OF DETECTING DULL AND WORN CUTTER BITS

RELATED APPLICATIONS

The present application claims priority to U.S. patent application Ser. No. 15/094,037, filed Apr. 8, 2016, which claims priority to U.S. Provisional Application No. 62/145,377, filed Apr. 9, 2015, the entire contents both of which are hereby incorporated.

BACKGROUND

The present application relates to industrial machines, such as but not limited to, mining machines.

SUMMARY

Underground mining machines, such as long wall shearers and continuous miners, use a plurality of cutter bits attached to a rotating cutter drum in order to mine (e.g., cut) material. In the process of cutting the material the cutter bits may become worn and/or dull, which in turn reduces the rate of extraction of the material.

Dull or worn cutter bits increase the force required to cut the material, thus reducing the efficiency of operation. Additionally, dull or worn bits generate increased amounts of airborne dust and particulates and may fail catastrophically, which may cause serious damage to additional processing equipment located down-stream if not detected and removed from the outgoing material. Typically, cutter bits are replaced opportunistically during breaks in mining and replacement is based on visual inspection. This process is arbitrary and inconsistent.

In one embodiment, the application provides a mining machine including a chassis, an actuator, a cutter drum supported by the chassis, the cutter drum driven by the actuator, a cutter bit coupled to the cutter drum, and a controller. The controller includes a processor and memory and is configured to measure a characteristic of the actuator, determine the cutter bit is worn based on the measured characteristic of the actuator, and output a signal when the cutter bit is determined to be worn.

In another embodiment the application provides a method of detecting wear of a cutter bit driven by an actuator of a mining machine. The method including monitoring, via a sensor, a characteristic of the actuator; determining, via a controller, the cutter bit is worn based on the characteristic of the actuator; and outputting, from the controller, a signal when the cutter bit is determined to be worn.

In another embodiment the application provides a mining machine including a chassis, an actuator, a cutter drum supported by the chassis, the cutter drum driven by the actuator, a cutter bit coupled to the cutter drum, and a controller. The controller includes a processor and memory and is configured to determine a rotational angle of the cutter drum, determine a net cutting force based on the rotational angle of the cutter drum, determine the cutter bit is worn based on the net cutting force, and output a signal when the cutter bit is determined to be worn.

In another embodiment the application provides a method of detecting wear of a cutter bit driven by an actuator of a mining machine having a cutter drum. The method includes monitoring, via a sensor, a rotational angle of the cutter drum, and determining, via a controller, a net cutting force of the mining machine based on the rotational angle of the cutter drum. The method further includes determining, via the controller, the cutter bit is worn based on the net cutting force of the mining machine, and outputting, from the controller, a signal when the cutter bit is determined to be worn.

Other aspects of the application will become apparent by consideration of the detailed description and accompanying drawings.

DETAILED DESCRIPTION

Before any embodiments of the application are explained in detail, it is to be understood that the application is not limited in its application to the details of the configuration and arrangement of components set forth in the following description or illustrated in the accompanying drawings. The application is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments of the application may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the application may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components may be utilized to implement the application. For example, "servers" and "computing devices" described in the specification can include one or more processing units, one or more computer-readable medium modules, one or more input/output interfaces, and various connections (e.g., a system bus) connecting the components.

Figure 1:
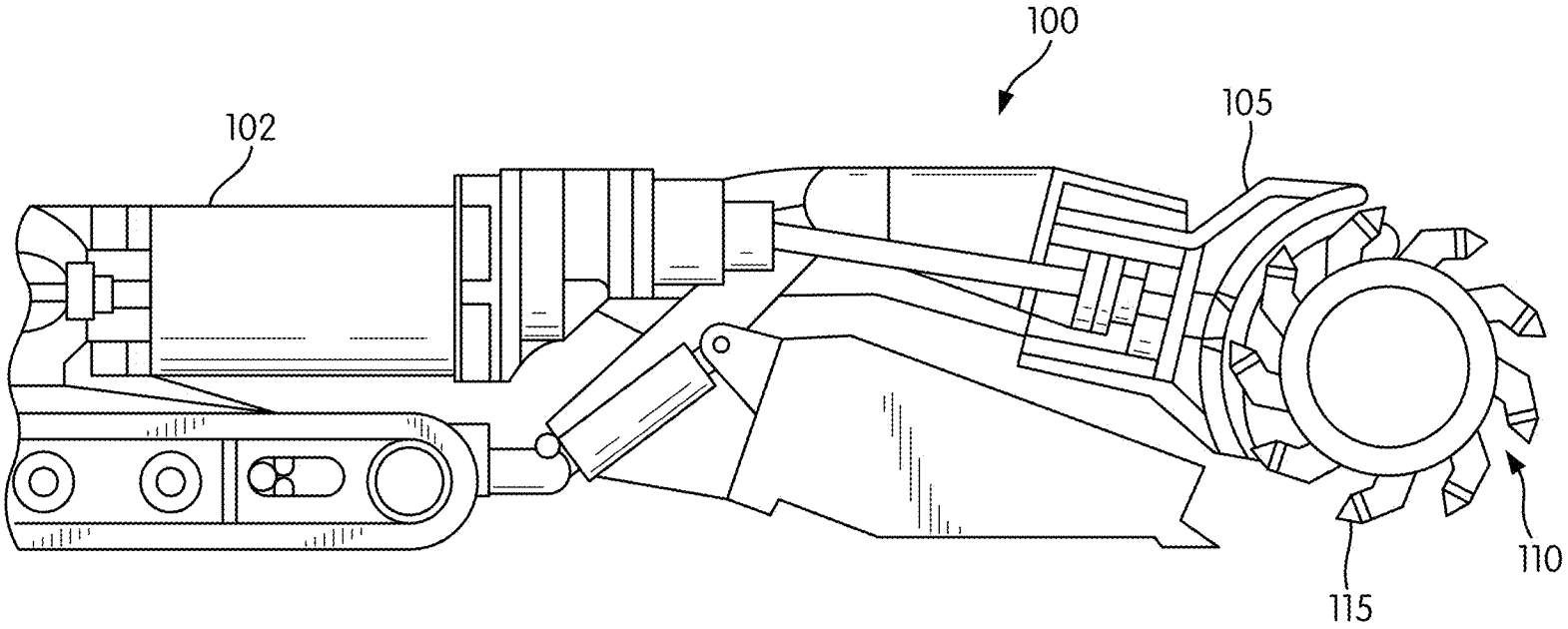
FIG. 1 illustrates a perspective view of a mining machine according to some embodiments.

FIG. 1 illustrates a mining machine 100, such as a continuous miner. Although illustrated as a continuous miner, in other embodiments (not shown), the mining machine 100 may be a long wall shearer, a rock crusher, or another type of mining machine. Additionally, the application is not limited to mining machines and may be used in conjunction with a variety of apparatuses having oscillating discs or drill bits.

The mining machine 100 includes a frame, or chassis, 102 supporting a cutter system 105, which includes a rotating drum 110 with one or more cutter bits 115 for cutting material (e.g., coal, salt, or another mined material) from a surface to be mined. The cutter system 105 is rotationally driven by one or more actuators 220 (FIG. 3) via a gear box 222 (FIG. 3), which mechanically connects the one or more actuators 220 to the rotating drum 110. That is, the gear box 222 (FIG. 3) receives output from the one or more actuators 220 and, in turn, drives the drum 110. The cutter bits 115 are replaceably coupled to the drum 110.

Figure 2:
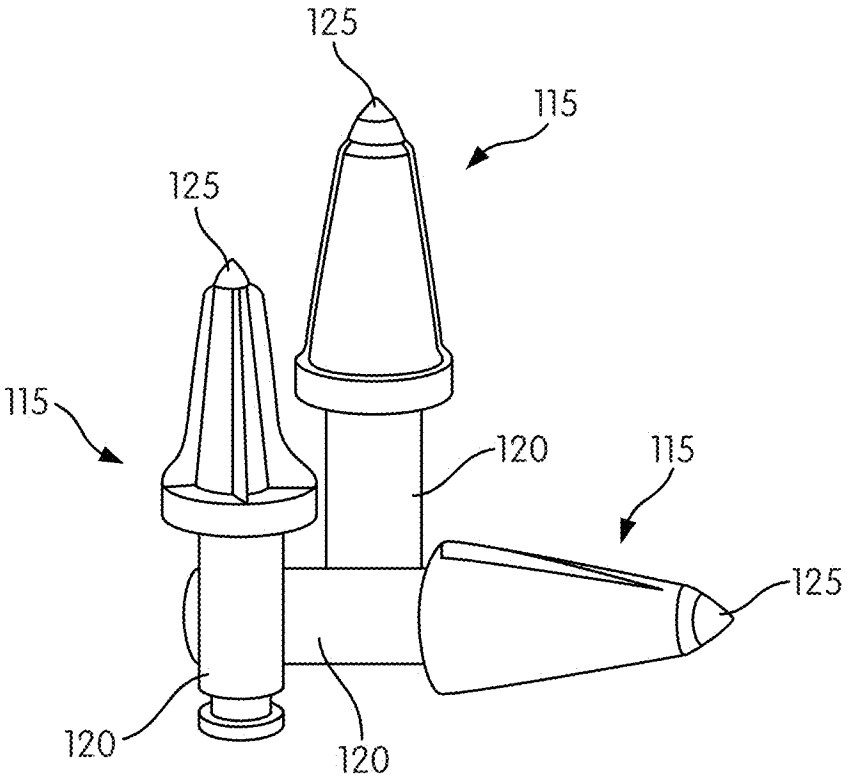
FIG. 2 illustrates a perspective view of individual cutter bits of the mining machine of FIG. 1 according to some embodiments of the application.

FIG. 2 illustrates individual cutter bits 115. Each cutter bit 115 includes a base 120 and a pick, or bit, 125. The base 120 releasably couples the cutter bit 115 to the drum 110. The pick 125 engages material (i.e., the pick 125 is forced through the in situ seam to extract the material). At any given time, multiple picks 125 may be engaged with the material.

Figure 3:
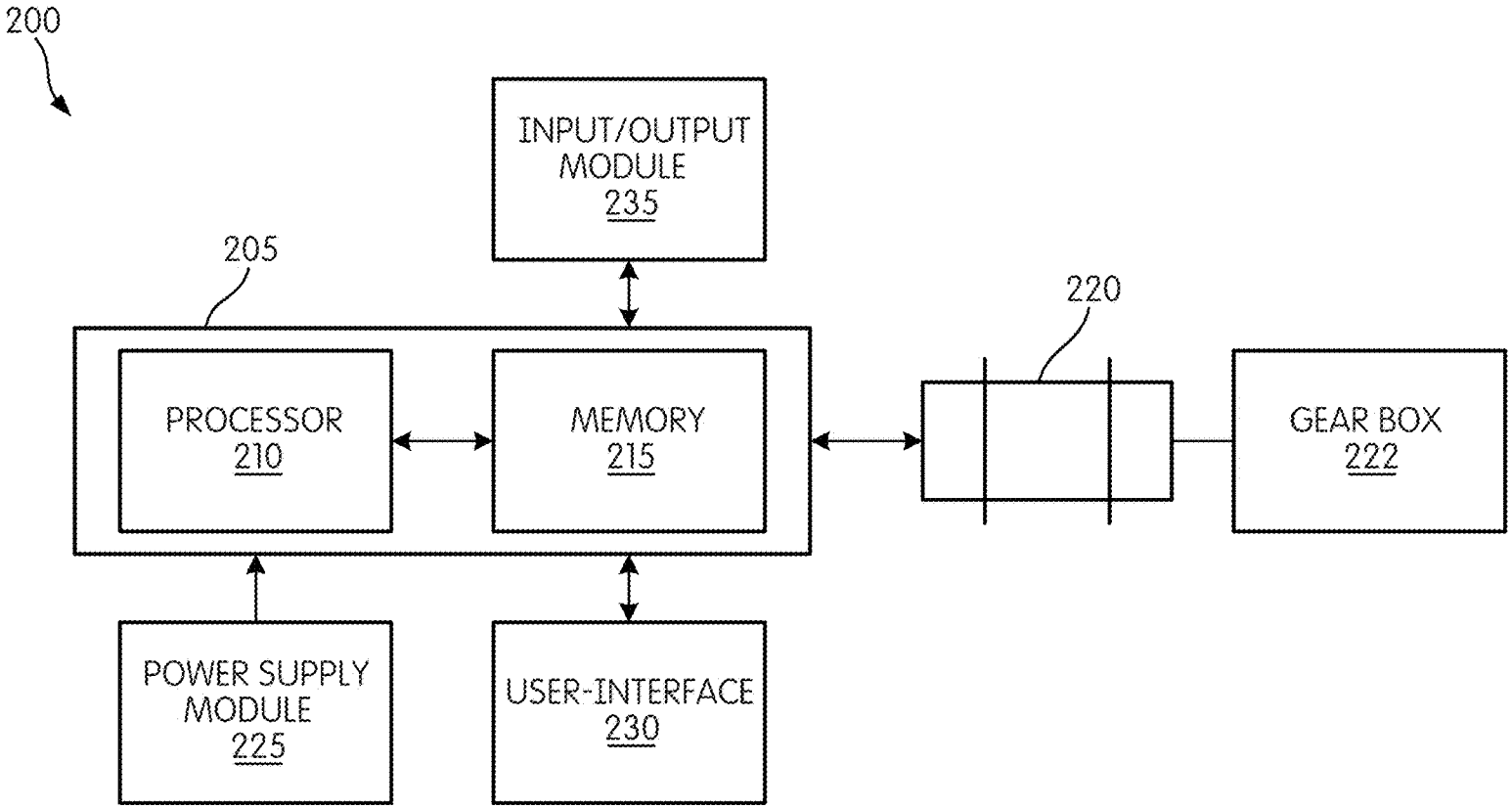
FIG. 3 illustrates a block diagram of a control system of the mining machine of FIG. 1 according to some embodiments of the application.

FIG. 3 is a block diagram illustrating a control system 200, an actuator 220, and the gear box 222, of the mining machine 100. The control system 200 includes a controller 205 having combinations of hardware and software that are operable to, among other things, control the operation of the mining machine 100 and operation of the control system 200. For example, the controller 205 includes a processor 210 and memory 215. The controller 205 is electrically and/or communicatively connected to a variety of modules or components of the mining machine 100, such as but not limited to, a power supply module 225, a user-interface 230, and an input/output (I/O) module 235. In some embodiments, the controller 205 is further electrically and/or communicatively connected to the one or more actuators 220.

In some embodiments, the controller 205 includes a plurality of electrical and electronic components that provide power, operational control, and protection to the components and modules within the controller 205 and/or mining machine 100. For example, the controller 205 includes, among other things, the processor 210 (e.g., a microprocessor, a microcontroller, or another suitable programmable device) and the memory 215. The processor 210 and the memory 215, as well as the various modules connected to the controller 205 are connected by one or more control and/or data buses. In some embodiments, the controller 205 is implemented partially or entirely on a semiconductor (e.g., a field-programmable gate array ["FPGA"] semiconductor) chip, such as a chip developed through a register transfer level ("RTL") design process.

The memory 215 includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices. The processor 210 is connected to the memory 215 and executes software instructions that are capable of being stored in a RAM of the memory 215 (e.g., during execution), a ROM of the memory 215 (e.g., on a generally permanent basis), or another non-transitory computer readable medium such as another memory or a disc. Software included in the implementation of the mining machine 100 can be stored in the memory 215 of the controller 205. The software includes, for example, firmware, one or more applications, program data, filters, rules, one or more program modules, and other executable instructions. The controller 205 is configured to retrieve from memory 215 and execute, among other things, instructions related to the control processes and methods described herein. In other constructions, the controller 205 includes additional, fewer, or different components.

As stated above, the controller 205 is further communicatively coupled to the one or more actuators 220. The actuator 220 rotationally drives the cutter system 105 via the gear box 222. The actuator 220 may be any actuator that applies a force (e.g., a rotational force, a linear force, etc.). In one embodiment, the actuator 220 is a motor, such as but not limited to, an alternating-current (AC) motor (e.g., a synchronous motor, an AC induction motor, etc.), a direct-current motor (e.g., a commutator direct-current motor, a permanent-magnet direct-current motor, a wound field direct-current motor, etc.), and a switch reluctance motor or other type of reluctance motor. In another embodiment, the actuator 220 is a hydraulic motor, such as but not limited to, a linear hydraulic motor (i.e., hydraulic cylinders) or a radial piston hydraulic motor. In some embodiments, the mining machine 100 includes a plurality of actuator 220 for operating various aspects of the mining machine 100. In such an embodiment, the actuators 220 may be a combination of AC motors, DC motors, and hydraulic motors. For example, but not limited to, an AC motor or DC motor may rotationally drive the cutter system 105 while a hydraulic motor reacts to cutting loads and positions the cutter system 105.

The power supply module 225 supplies a nominal AC or DC voltage to the controller 205 or other components or modules of the mining machine 100. The power supply module 225 is powered by, for example, a power source having nominal line voltages. The power supply module 225 is also configured to supply lower voltages to operate circuits and components within the controller 205 and/or mining machine 100. In other embodiments, the controller 205 or other components and modules within the mining machine 100 are powered by a grid-independent power source (e.g., a generator, a solar panel, a battery, etc.).

The user-interface 230 is used to control or monitor the mining machine 100. The user-interface 230 includes a combination of digital and analog input or output devices required to achieve a desired level of control and monitoring for the mining machine 100. For example, the user-interface 230 includes a display (e.g., a primary display, a secondary display, etc.) and input devices such as touch-screen displays, a plurality of knobs, dials, switches, buttons, etc. The display is, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, etc. The user-interface 230 can also be configured to display conditions or data associated with the mining machine 100 in real-time or substantially real-time. For example, the user-interface 230 is configured to display measured electrical characteristics of the mining machine 100 and the status of the mining machine 100. In some implementations, the user-interface 230 is controlled in conjunction with the one or more indicators (e.g., LEDs, speakers, etc.) to provide visual or auditory indications of the status or conditions of the mining machine 100.

The I/O module 235 is configured to input and output data from the controller 205 to an outside device(s). As discussed in more detail below, the I/O module 235 may input and output data wirelessly or via wire. In some embodiments, although not illustrated, the I/O module 235 may be communicatively coupled to a network module. The network module is configured to connect to and communicate through a network. In some embodiments, the network is, for example, a wide area network ("WAN") (e.g., a TCP/IP based network, a cellular network, such as, for example, a Global System for Mobile Communications ["GSM"] network, a General Packet Radio Service ["GPRS"] network, a Code Division Multiple Access ["CDMA"] network, an Evolution-Data Optimized ["EV-DO"] network, an Enhanced Data Rates for GSM Evolution ["EDGE"] network, a 3GSM network, a 4GSM network, a Digital Enhanced Cordless Telecommunications ["DECT"] network, a Digital AMPS ["IS-136/TDMA"] network, or an Integrated Digital Enhanced Network ["iDEN"] network, etc.).

In other embodiments, the network is, for example, a local area network ("LAN"), a neighborhood area network ("NAN"), a home area network ("HAN"), or personal area network ("PAN") employing any of a variety of communications protocols, such as Wi-Fi, Bluetooth, ZigBee, etc. Communications through the network by the network module or the controller 205 can be protected using one or more encryption techniques, such as those techniques provided in the IEEE 802.1 standard for port-based network security, pre-shared key, Extensible Authentication Protocol ("EAP"), Wired Equivalency Privacy ("WEP"), Temporal Key Integrity Protocol ("TKIP"), Wi-Fi Protected Access ("WPA"), etc. The connections between the network module and the network are, for example, wired connections, wireless connections, or a combination of wireless and wired connections. Similarly, the connections between the controller 205 and the network or the network module are wired connections, wireless connections, or a combination of wireless and wired connections. In some embodiments, the controller 205 or network module includes one or more communications ports (e.g., Ethernet, serial advanced technology attachment ["SATA"], universal serial bus ["USB"], integrated drive electronics ["IDE"], etc.) for transferring, receiving, or storing data associated with the mining machine 100 or the operation of the mining machine 100.

In operation, as the drum 110 rotates, individual picks 125 are forced into engagement with the mine face in order to extract the material to be mined. A force is applied to the individual picks 125 in order to maintain engagement with the material and maintain movement through the material. At any given time, multiple picks 125 may be engaged with the material. The forces of the individual pick 125 engaged with the material combine to generate a net cutting force. The net cutting force and a torque of the one or more actuators 220 (e.g., torque on rotating drum 110) are combined to produce the cutting loads of the mining machine 100.

The net cutting forces (e.g., the level and variations of the net cutting forces), the torque of the one or more actuators 220 (e.g., the level and variations of the torque of the rotating drum 110), and a production rate of the mining machine 100 (i.e., the amount of material mined by the mining machine 100 during a predetermined time period) are monitored over time. Changes in the cutting loads (e.g., net cutting forces and torque) and the production rate can then be used to detect dull or missing picks 125.

In some embodiments, the cutting loads (e.g., net cutting forces and torque of the rotating drum 110) can be monitored via voltage and current sensing of the actuator, or actuators, 220. In another embodiment, the cutting loads can be monitored via voltage and current sensing of the actuators and pressure sensing of the hydraulic system. In such embodiments, a model-based estimator inverts the system dynamics to enable the quantification of the cutting loads from the sensed voltage, current, and/or pressure measurements.

The quantification of the cutting loads can then be averaged in real time, tracked over predetermined time periods, and compared to the production rate of the mining machine 100. Dull or worn picks 125 can be detected by monitoring: (1) changes in the relationship between the cutting loads and production rate, as compared to data acquired over the recent operation of the mining machine 100; and (2) changes in the relationship between cutting loads (e.g., between the average torque and the transverse, or vertical cutting force, on the cutter system 105). Herein, the terms "dull" or "worn" may be defined as a predetermined amount of wear on a pick 125. For example, but not limited to, dull or worn may be defined as a predetermined distance of deterioration on a pick 125. As another example, but not limited to, dull or worn may be defined as a predetermined percentage of deterioration on a pick 125.

In some embodiments, a resolver is used to facilitate accurate measurement of the rotational angle of the cutter system 105 with respect to a defined reference angle on the mining machine 100 (e.g., the chassis 102). In such an embodiment, the cutting loads are estimated in real time and the instantaneous cutting loads are correlated against the angle of the cutter system 105. Deviations between the cutting load profiles (e.g., force and torque versus angle of the cutter system 105) and baseline cutting load profiles, indicate dull or missing picks 125. A known pick lacing of the cutter system 105 is used to determine the most likely combination of picks 125 that are dull or missing to generate the observed deviation from the baseline cutting load profile.

Figure 4:
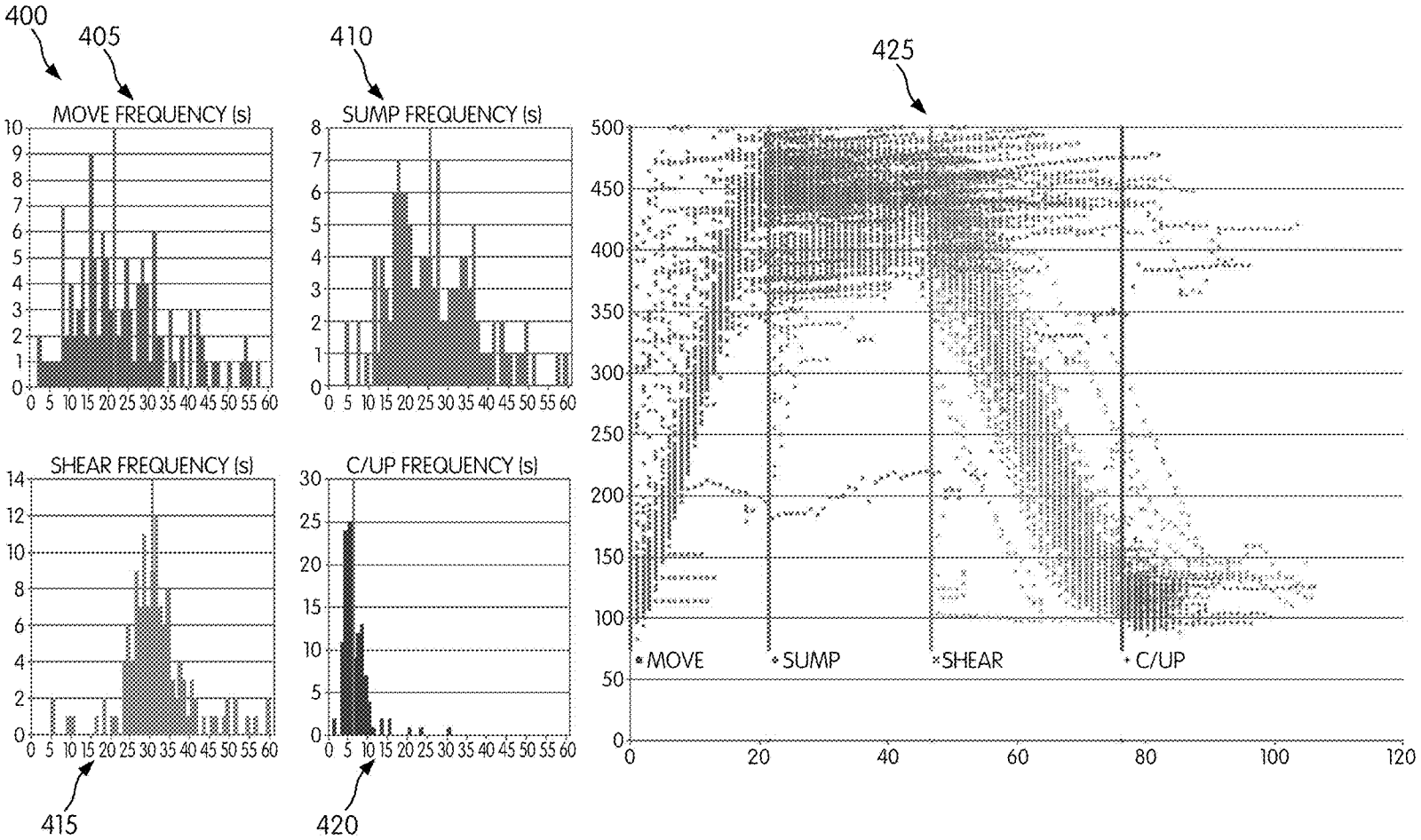
FIG. 4 illustrates a plurality of charts used by the control system of FIG. 3 according to some embodiments of the application.

FIG. 4 illustrates a plurality of phase frequency charts 400. The phase frequency charts 400 graphically illustrate the performance of the mining machine 100 during an operational state (e.g., an operational cycle). In some embodiments, the performance of the mining machine 100 is determined by the amount of time the mining machine 100 takes to complete the operational state. The plotted points of the phase frequency charts 400 may vary over successive operational states, as performance of the mining machine 100 and/or the environment changes.

In one embodiment of operation, the phase frequency charts 400 are used to measure rate of production during an operational state. In such an embodiment, the phase frequency charts 400 may be used in the analysis of changes in the relationship between the cutting loads and the production rate, as described above.

In some embodiments, the phase frequency charts 400 illustrate histograms of the frequencies during each phase of the operational state. In some embodiments, the frequency is the number of occurrences of a repeating event, such as but not limited to, a specific phase of an operational state per unit time. In such an embodiment, the operational state may include the following phases: move; sump; shear; trim; and raise head.

In the illustrated embodiment, the plurality of phase frequency charts 400 include a move frequency chart 405, a sump frequency chart 410, a shear frequency chart 415, a clean-up (C/UP) frequency chart 420, and a combination chart 425, the phase frequency charts may include more or less. Move, sump, shear, and clean-up are examples of phases of the mining machine 100 during an operational state.

The real time cutting load estimates are input into a filtering algorithm. The filtering algorithm uses the known pick lacing of the cutter system 105 and a force model of the cutting action of the picks 125 to estimate a percentage of wear on the individual picks 125. The filtering algorithm simultaneously estimates the angle of engagement between the cutter system 105 and the seam, as well as a wear parameter for each pick 125. The level of wear of a pick 125 is monitored against a predetermined threshold. When the level of wear of a pick 125 surpasses the predetermined threshold, it is time for replacement of the pick 125.

Figure 5:
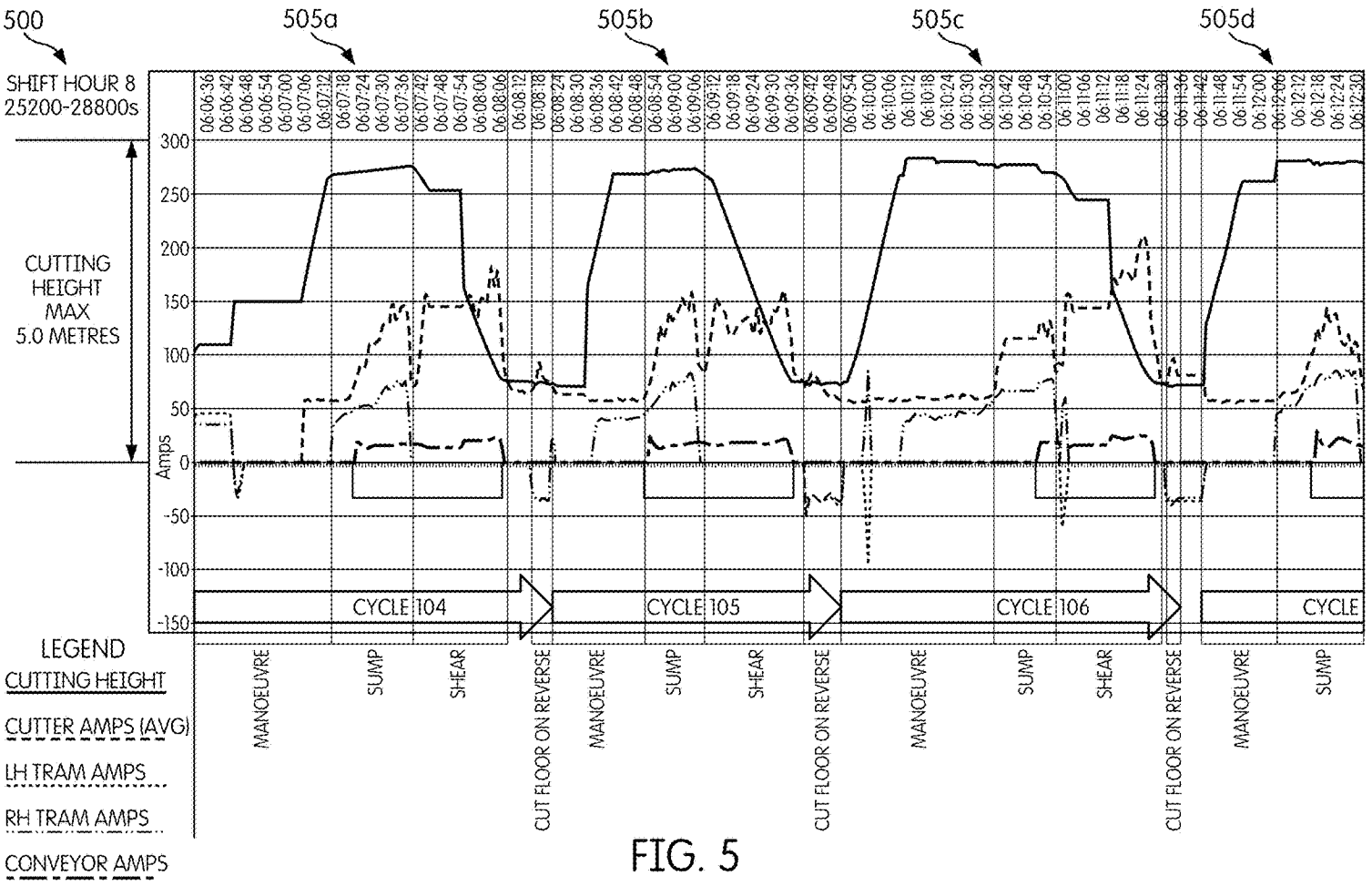
FIG. 5 illustrates a chart used by the control system of FIG. 3 according to some embodiments of the application.

FIG. 5 illustrates a chart 500, which graphically represents the amount of energy used by a plurality of components of the mining machine 100 during a time period. In some embodiments, the time period includes a plurality of operational states. In one embodiment, energy is graphically represented as current (A) over one or more operational states (e.g., cutting cycles 505*a*, 505*b*, 505*c*, 505*d*). In some embodiments, current (A) is used as a proxy for energy usage of the mining machine 100. In such an embodiment, the current (A) is plotted against the elevation of the cutter system 105 and the current operational state. The current operational state of the mining machine 100 may then be used as a basis for comparison of the production rate to the average cutting loads as discussed above.

In some embodiments, each operational state includes events (e.g., phases), such as: move (maneuver); sump; shear; trim; and raise head. In other embodiments, each operational state may include more or less events. In some embodiments, the chart 500 further includes other activities of the mining machine 100. In such an embodiment, the other activities may include, but are not limited to: half-sumping during cycles, idle time during cycles, relocation of the mining machine 100, and general floor cleaning.

Figure 6:
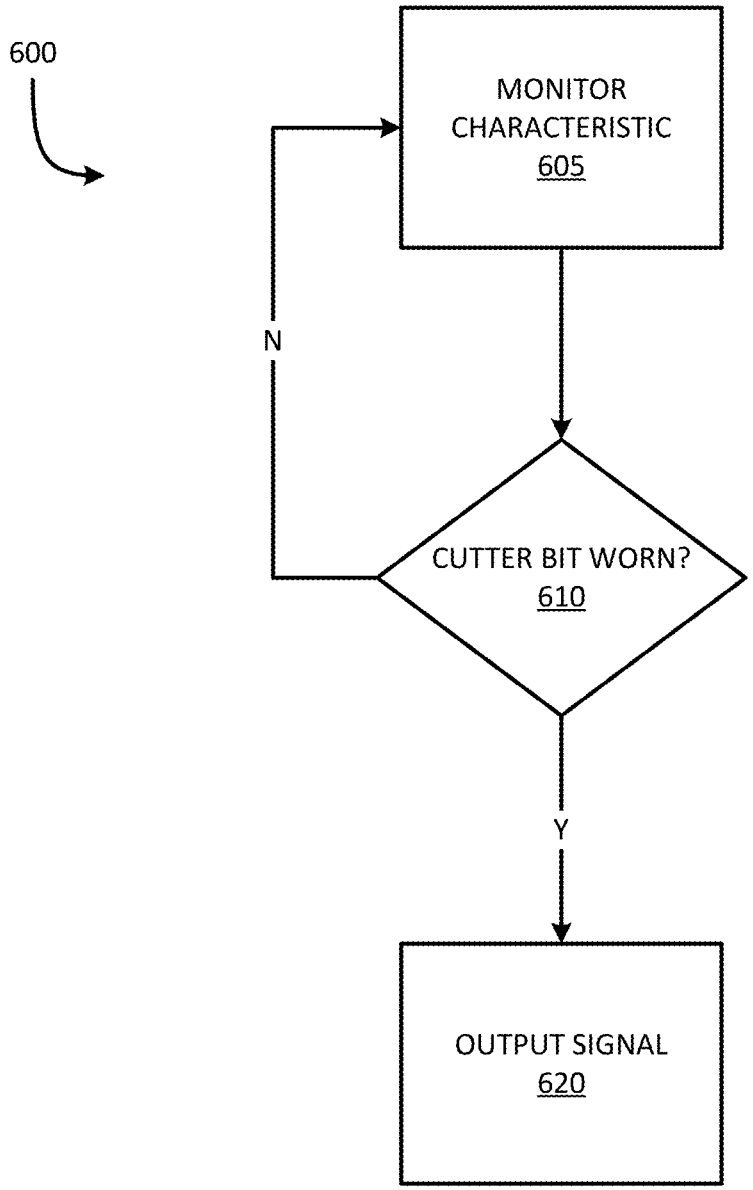
FIG. 6 illustrates a process of the control system of FIG. 3 according to some embodiments of the application.

FIG. 6 is a flow chart illustrating a process 600 of the mining machine 100 according to some embodiments of the application. It should be understood that the order of the steps disclosed in process 600 could vary. Furthermore, additional steps may be added to the sequence and not all of the steps may be required.

At step 605, the control system 200, or controller 205, monitors a characteristic of the one or more actuators 220. The control system 200, or controller 205, next determines if one or more cutter bits are dull or worn based on the monitored characteristic (step 610). When the control system 200, or controller 205, determines that one or more cutter bits are dull or worn, a signal is output (step 620). When the control system 200, or controller 205, determines that at least one cutter bit is not dull or worn, the process 600 cycles back to step 605 and continues to monitor a characteristic of the one or more actuators 220.

Thus, the application provides, among other things, a system and method for detecting dull and worn cutter bits using net cutting forces, torque, and production rate. The system and method may be used with a variety of mining machines or a variety of apparatuses having oscillating discs or drill bits.

What is claimed is:

1. An industrial machine comprising:
a chassis;
an actuator;
a cutter drum supported by the chassis, the cutter drum driven by the actuator;
a cutter bit coupled to the cutter drum; and
a controller, having a processor and memory, the controller configured to
determine an angle of the cutter drum with respect to the chassis,
determine a cutting load based on the angle of the cutter drum,
determine the cutter bit is worn based on the cutting load, and
output a signal when the cutter bit is determined to be worn.

2. The industrial machine of claim 1, wherein the actuator is a motor.

3. The industrial machine of claim 1, wherein the actuator is a hydraulic system.

4. The industrial machine of claim 1, wherein the cutter bit is worn at a predetermined length of deterioration.

5. The industrial machine of claim 1, wherein the cutter bit is worn at a predetermined percentage of deterioration.

6. The industrial machine of claim 1, wherein the actuator is a motor rotationally driving the cutter drum and the industrial machine further comprises a hydraulic system positioning the cutter drum.

7. The industrial machine of claim 1, wherein the controller is further configured to determine one or more cutting loads of the industrial machine based on the net cutting force and a characteristic of the actuator.

8. The industrial machine of claim 7, wherein the cutter bit is determined to be worn based on changes in a relationship between the cutting loads and a production rate.

9. The industrial machine of claim 7, wherein the cutter bit is determined to be worn based on changes in a relationship between two or more cutting loads.

10. The industrial machine of claim 1, wherein the cutting load includes at least one selected from the group consisting of a net cutting force and a torque.

11. The industrial machine of claim 1, wherein the cutting load is determined based on the angle of the cutter drum by:
monitoring at least one selected from the group consisting of a voltage of the actuator, an current of the actuator, and a pressure of a hydraulic apparatus of the cutter drum.

12. A method of detecting wear of a cutter bit driven by an actuator of an industrial machine having a cutter drum, the method comprising:
monitoring, via a sensor, an angle of the cutter drum with respect to the chassis;
determining, via a controller, a cutting load of the industrial machine based on the angle of the cutter drum;
determining, via the controller, the cutter bit is worn based on the cutting load of the industrial machine; and
outputting, from the controller, a signal when the cutter bit is determined to be worn.

13. The method of claim 12, wherein the cutter bit is worn at a predetermined length of deterioration.

14. The method of claim 12, wherein the cutter bit is worn at a predetermined percentage of deterioration.

15. The method of claim 12, further comprising
rotationally driving, via the actuator, the cutter drum, and
positioning, via a hydraulic system, the cutter drum.

16. The method of claim 12, further comprising
determining, via the controller, one or more cutting loads of the industrial machine based on the net cutting force and a characteristic of the actuator.

17. The method of claim 16, wherein the cutter bit is determined to be worn based on changes in a relationship between the cutting loads and a production rate.

18. The method of claim 16, wherein the cutter bit is determined to be worn based on changes in a relationship between two or more cutting loads.

19. The method of claim 12, wherein the cutting load includes at least one selected from the group consisting of a net cutting force and a torque.

20. The method of claim 12, wherein the cutting load is determined based on the angle of the cutter drum by:

monitoring at least one selected from the group consisting of a voltage of the actuator, an current of the actuator, and a pressure of a hydraulic apparatus of the cutter drum.

* * * * *